United States Patent [19]

McPeak

[11] 4,090,708

[45] May 23, 1978

[54] APPARATUS FOR MARKING FOOTBALL FIELDS

[76] Inventor: Walter G. McPeak, 221½ S. Blvd., Tallahassee, Fla. 32301

[21] Appl. No.: 735,847

[22] Filed: Oct. 26, 1976

[51] Int. Cl.[2] ..... A63B 67/00

[52] U.S. Cl. ..... 273/55 R; 33/289

[58] Field of Search ..... 273/55 R; 33/46.07, 33/158, 276, 289, 293, 294, 287, 288; 356/172, 152, 138, 139, 140, 141, 142, 143, 144, 145, 146, 147, 148, 149, 247, 248, 249, 250, 152, 253, 254, 255; 340/323, 258 B, 421; 350/288, 299

[56] References Cited

U.S. PATENT DOCUMENTS

| | | | |
|---|---|---|---|
| 3,741,662 | 6/1973 | Pioch | 273/55 R |
| 3,752,588 | 8/1973 | Chapman | 356/152 |
| 3,810,148 | 5/1974 | Kersten | 340/323 |
| 3,816,000 | 6/1974 | Fielder | 356/172 |
| 3,985,356 | 10/1976 | Carlock | 273/55 R |

FOREIGN PATENT DOCUMENTS

| | | | |
|---|---|---|---|
| 135,194 | 5/1933 | Germany | 273/29 R |

*Primary Examiner*—Richard C. Pinkham

*Assistant Examiner*—T. Brown

*Attorney, Agent, or Firm*—Robert Brown, Jr.

[57] ABSTRACT

Apparatus for providing illuminated columns or signals for use as first down lines of demarcation on football fields. The signs may comprise: (1) a single laser light beam having a luminous horizontal segment directed across the field and serving as an overhead line of demarcation, in combination with a relatively lower parallel luminous segment of the same beam, reflected reversely across the field and serving as a ground line of demarcation, or (2) two oppositely travelling light beams having a pair horizontal luminous segments serving as a composite overhead line of demarcation, in combination with a second pair of horizontal relatively lower luminous segments of the same beams serving as the ground line of demarcation, or (3) either the overhead or the ground line of demarcation of the last-named combination. During a game, the sign is used as a reference by game officials, players, and spectators for approximating and/or determining the relative position of a football lying on the field at the beginning of or between successive downs.

9 Claims, 17 Drawing Figures

IA
IB

APPARATUS FOR MARKING FOOTBALL FIELDS

This invention relates to football equipment and more especially to marking apparatus employing laser light beam segments extending transversely across the playing field and utilized as a reference line when locating the position of the ball longitudinally of the field. As used in this application, the term "segment" refers to the beam portion or length initially projected from a laser, or to any subsequently directed or reflected portion or length of the beam.

Heretofore, laser light beams have been employed as markers on football fields, tennis courts and the like as may be observed from the Pioch U.S. Pat. No. 3,741,662 and the Chapman U.S. Pat. No 3,752,588; but so far as applicant is aware, such prior art concepts have not been developed so as to meet with appreciable market acceptance.

One of the principal drawbacks to the above patented devices is the time-consuming and tedious method of operation. Since the projector is located several feet above the field level and mounted for oscillation in a vertical plane, a projected beam must strike the field at acute angles at points of reference lying on an imaginary line of demarcation defined by the intersection of said plane with the field surface. Accordingly, it is necessary for the operator to manipulate the projector for each reference point established.

It is therefore an object of this invention to provide a marking apparatus of the class described which projects a composite laser light column in spaced parallel juxtaposition above the field surface and which is utilized as a demarcation line. The expression "composite light column or line of demarcation" as used in this application refers to two visible luminous beam segments travelling alongside one another in opposite directions across the field and jointly serving as a first down mark.

It is another object of this invention to provide a marker defined in the immediately preceding paragraph wherein said continuous light column is composed of a pair of substantially contiguous segments travelling in opposite directions.

It is another object of this invention to provide a luminous first down line of demarcation comprising a pair of horizontally disposed composite light columns, of which one is juxtaposed adjacently above the field surface to serve as a ground reference or mark, and the other is spaced vertically thereabove to serve as an overhead reference or mark during a football game.

Still further objects of this invention are to provide an improved football field marking apparatus having visible light beam projecting apparatus and which: shows the fans, game officials and players precisely where a first down or other demarcation line is located; permits pass receivers and ball carriers wishing to advance the ball far enough to make a first down, to look back and see the ball and upper or overhead signal at the same time; facilitates accurate placement of the ball on the field; enables the referee to better observe if a player lines up off sides before a play starts; eliminates the necessity for the referee to use chains on the field to measure close calls; includes tracks flush-top with the field level to avoid injury to persons walking or running in the area, and to permit the light beams to be projected horizontally of the field at any location along its length; and which is fast and easy to set up before a game.

Some of the objects of invention having been stated, other objects will appear as the description proceeds when taken in connection with the accompanying drawings, in which —

Figures 9, 10, 11, 12, 13, 14:
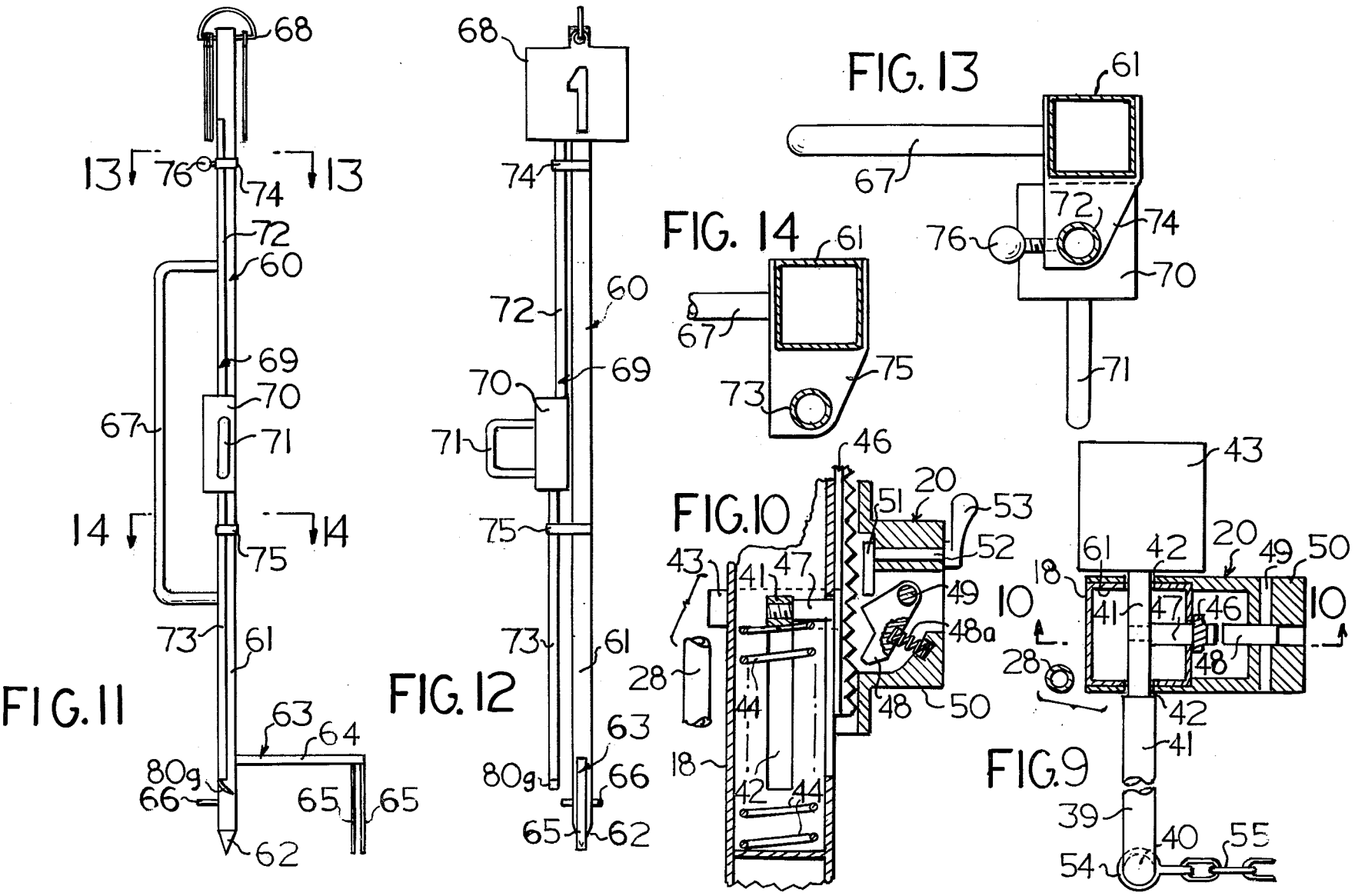
FIG. 9 is a sectional plan view taken along line 9—9 in FIG. 3, showing the detailed construction of a foot-operated anchor mechanism for the marker component.
FIG. 10 is a vertical sectional detail view taken along line 10—10 in FIG. 9.

FIG. 11 a side elevation of the scrimmage line marking component of the apparatus;

FIG. 12 is a front elevation of the component shown in FIG. 11;

FIG. 13 is a sectional plan view taken along line 13—13 in FIG. 11, and FIG. 14 is a sectional plan view taken along line 14—14 in FIG. 11.

Referring more particularly to the drawings, the numeral 10 denotes a rectangular football field having longitudinal sidelines 11 and transverse yard lines 12. Identical trackways 14 and 14A are installed adjacent and parallel to the sidelines respectively, each of said trackways having a pair of spaced rails 15 positioned flush-top with the playing field 10 so as to avoid injury to anyone running or walking in the area.

Figures 1, 1A, 1B:
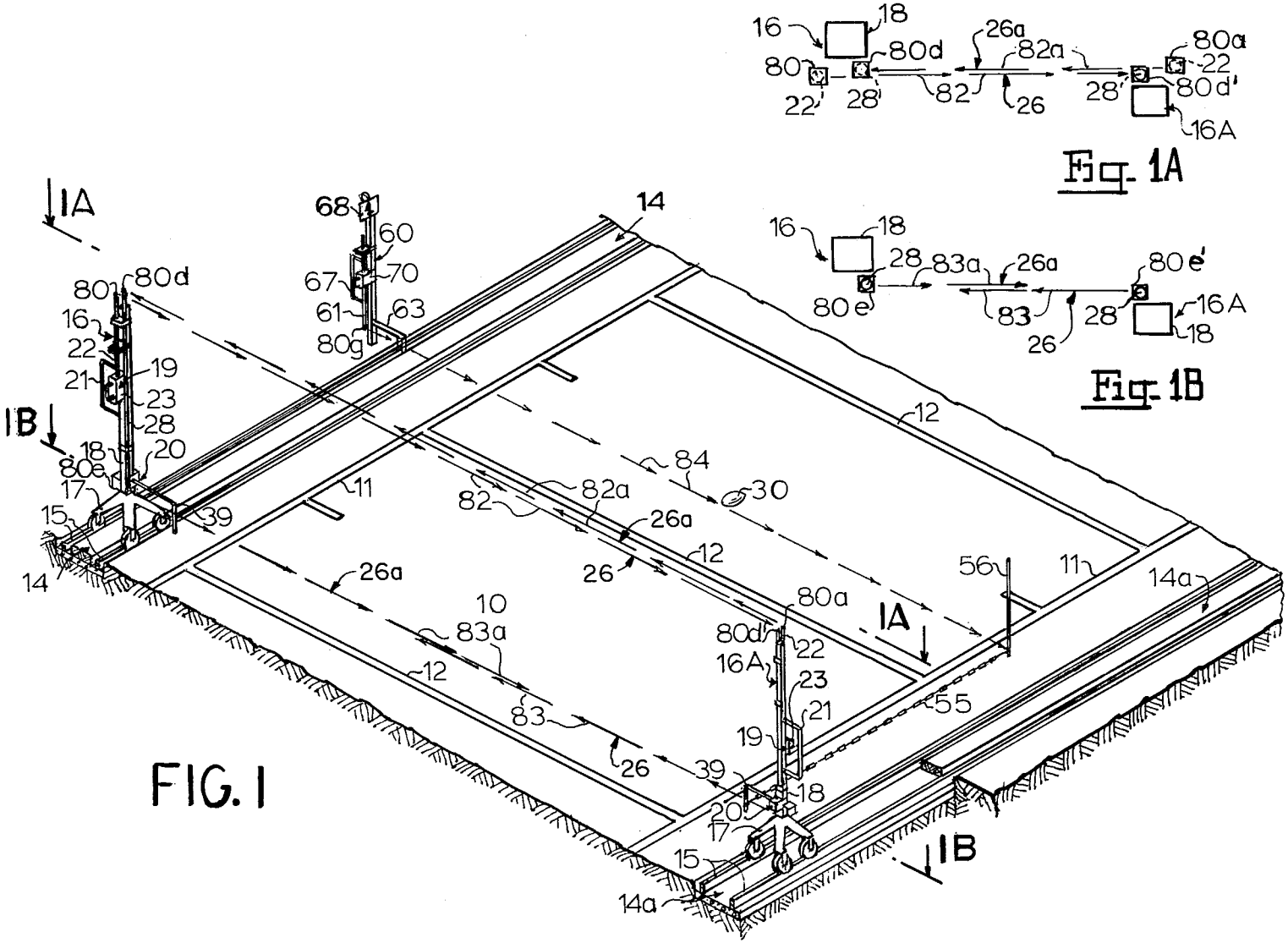
FIG. 1 is a schematic isometric view of a football field showing my improved marking apparatus in operating position thereon.
FIG. 1A is a plan view taken along line 1A—1A of FIG. 1.
FIG. 1B is a plan view taken along line 1B—1B of FIG. 1.

Mounted on trackways 14, 14A are identical beam directing assemblies 16, 16A respectively. These assemblies complement one another to provide the aforementioned pair of vertically spaced composite overhead and ground lines of demarcation, or else a pair vertically spaced luminous segments of a common beam and serving as the overhead and ground lines of demarcation respectively. Each assembly 16, 16A consists of: a wheeled base 17 mounted on the trackway; a vertical support pole 18 extending upwardly from the base; a laser light beam sending and receiving assembly 19; and anchor assembly 20; and a handle 21 for the unit (FIGS. 1, 2 and 3).

Figures 2, 3, 4, 4A, 5, 6, 7, 8:
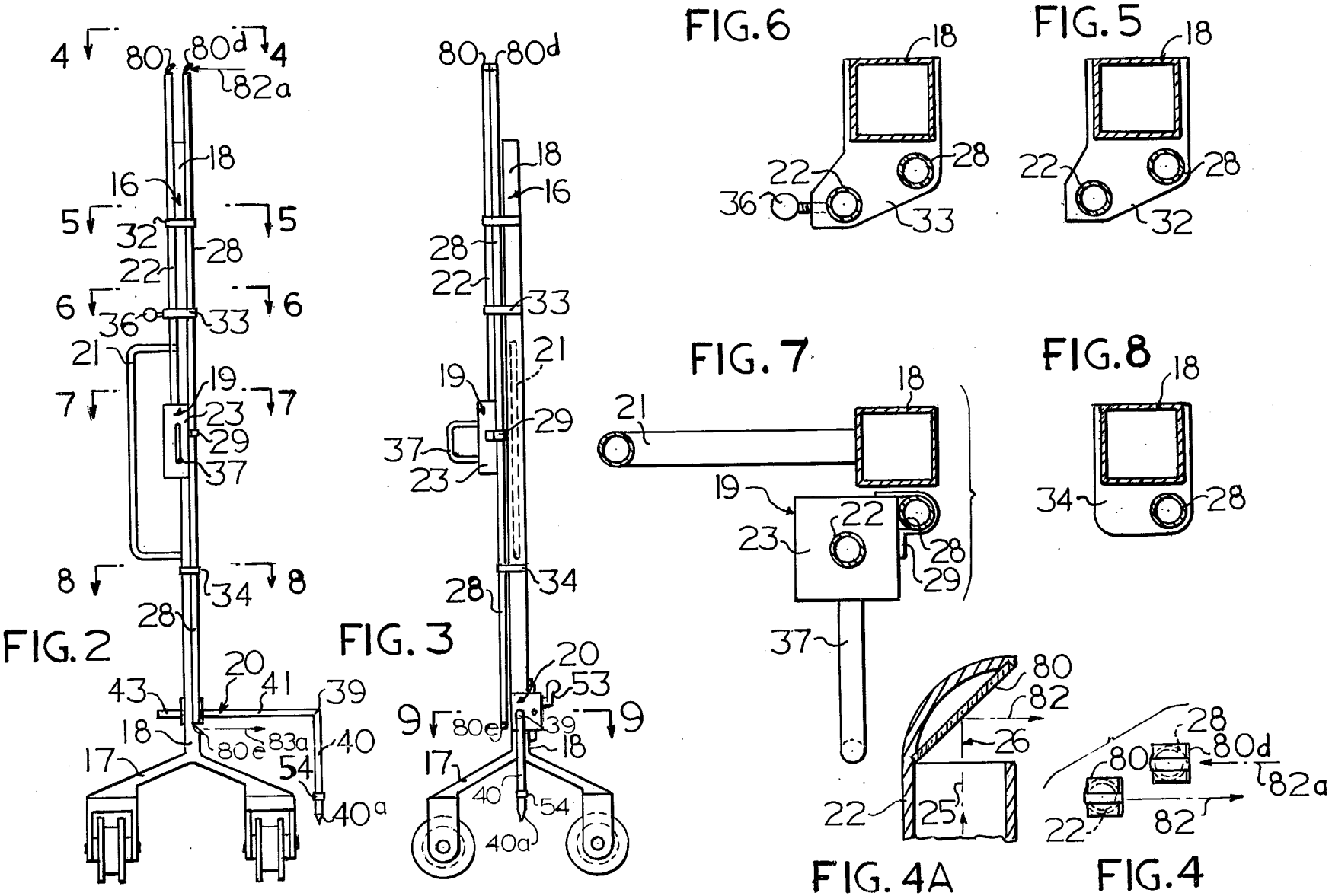
FIG. 2 is a side elevation of the first down marking component of the apparatus.
FIG. 3 is a front elevation of the component.
FIG. 4 is a top plan view taken along line 4—4 in FIG. 2.
FIG. 4A is an enlarged vertical sectional view through the ends of the laser tunnels and through the 90° corner mirror thereon.
FIG. 5 is a sectional plan view taken along line 5—5 in FIG. 2.
FIG. 6 is a sectional plan view taken along line 6—6 in FIG. 2.
FIG. 7 is a sectional plan view taken along line 7—7 in FIG. 2.
FIG. 8 is a sectional plan view taken along line 8—8 in FIG. 2.

The laser beam projecting and receiving assembly 19 includes a laser 23 having a tunnel or tube 22 extending upwardly therefrom, preferably to a height above the players and game officials on the field, the upper end of the tunnel having a 90-degree angle corner mirror 80 (FIGS. 4 and 4A). Laser 23 projects a segment 25 of a beam 26 upwardly through the tunnel 22 to corner mirror 80 which, in turn, reflects a second segment 82 of the beam horizontally across the field 10 as described later in detail.

Positioned vertically and parallel alongside tunnel 22 is a second tunnel 28. The upper end of tunnel 28 likewise has a 90° angle corner mirror **80*d* mounted thereon at the same elevation as that of mirror 80 on tunnel 22 (FIGS. 2 and 3), said mirrors being identical but given different reference numerals for the purpose of description. The lower end of tunnel 28 terminates at a relatively low level above the field and has another 90° angle mirror 80*e* thereon. The mirror 80*d* receives a horizontal light segment 82*a* reflected from the opposite side of the field, as will be described later. Mirror 80*d* reflects the segment 82*a* downwardly through the tunnel 28 to the mirror 80*e*, the latter mirror reflecting a horizontal light segment 83*a* across the field 10 (FIG. 1). The parts 22, 23 and 28 of assembly 19 are rigidly secured to one another as at 29 (FIG. 7**).

The assembly 19 is slidably supported by brackets 32, 33 and 34 welded or otherwise fixedly secured to support pole 18. In order to vertically adjust the assembly to selected fixed positions, a suitable set screw 36 is threadably mounted in bracket 33 (FIGS. 1, 2 and 7). A handle 37 attached to the laser 23 facilitates movement of the assembly 19 to the selected positions.

Each of the markers 16 and 16A is releasably held in stationary position on one of the trackways 14 or 14A by a ground anchor assembly 20 (FIGS. 2, 3, 9 and 10). The assembly comprises an L-shaped bar 39 having a vertical leg 40 sharpened at its lower end as at **40*a*, a horizontal leg 41 projecting through vertically disposed slots 42 in support pole 18, a compression spring 44 for yieldingly pressing the horizontal leg 41 upwardly toward the ends of slots, and a foot operated pedal 43 on the end of leg 41 remote from vertical leg 40. When the leg 40 is in disengaged position with the ground, the spring 44 presses the L-shaped bar 39 upwardly to the position shown in FIG. 9; and when it is desired to engage or anchor the bar, foot pressure is applied to the pedal 43. In order to releasably latch the anchor bar 39 in anchoring position, any suitable means such as latch assembly 45 is provided, said assembly comprising a rack 46 vertically slidable alongside the outer surface of pole 18, a lateral extension projecting laterally from the rack through vertically disposed slot 42*a* and connected to horizontal bar 41, a spring-pressed dog 48, a cam 51 and a handle 53** for operating the cam.

The rack 46 is adapted to be releasably engaged by the free end of dog 48 which is normally in engagement with the rack by spring **48*a*, said dog being being engagable by cam 51 when held in disengaged position as shown in FIG. 10. Cam 51 is mounted on one end of a horizontal shaft 52 rotatably mounted in housing 50 which, in turn, is secured in fixed position to pole 18. The other or outer end of shaft 52 has an operating lever 53 secured thereon. When it is desired to permit dog 48 to assume latched position and in engaged position with the teeth of rack 46, the cam 51 is rotated from the position shown in FIG. 10 to a position where the low side 51*a*** is positioned opposite the free end of the dog.

The vertical leg 40 of the above-described L-shaped bar 39 has a swivelled connection 54 thereon to which the forward end of a standard 10-foot chain 55 is attached, the other end of the chain being attached to a rod 56 (FIGS. 4 and 9). With the swivelled connection 54, it is simple and fast to change directions when the ball goes over to the other team. Moreover, when the vertical leg 40 of the bar 39 is anchored in the ground, the connection is pressed to ground level to allow the chain 55 to lie flat on the ground in its stretched measuring position, rather than in suspended position as often is the case.

When the markers 16 and 16A are positioned on opposite sides of the field and also opposite one another in operating positions along a first down line as shown in FIG. 1, the positions of tunnels 22 and 28 are reversed causing the corner mirror 80 on the upper end of tunnel 22 of marker 16 to be horizontally alined with corner mirror **80*d*' on the upper end of tunnel 28 of marker 16A. This reversal will also cause mirror 80*d* on the upper end of tunnel 28 of marker 16 to be alined with mirror 80*a* on the upper end of tunnel 22 of marker 16A. However, the corner mirror 80*e* on the lower end of tunnel 28 of marker 16 will not have a mirror or reflecting means on the oppositely positioned marker 16A, but instead, will be slightly offset laterally with reference to the opposed mirror 80*e*'**.

In the above-described positions of the mirrors and tunnels of marker assemblies 16 and 16A, the previously described luminous segment 82 of laser beam 26 (FIGS. 1, 4 and 4A) travels horizontally in one direction across the field while segment **82*a* of beam 26*a* travels in an opposite direction alongside luminous segment 82 to form an overhead composite line of demarcation. Likewise, luminous segments 83 and 83*a* of beams 26 and 26*a*** travel alongsideone another at a lower level and in opposite directions to form a composite ground line of demarcation.

A very important result flowing from the oppositely travelling light segments 83, **83*a* disposed adjacent the field level is the maintenance of continuity of one of the light segments across the field when the composite light column is blocked by a field occupant. In other words, when a player steps in the path of the oppositely travelling beams 83, 83*a* a few feet from a sideline, one of the beam segments will be blocked while the other segment coming from the opposite sideline will remain visible. In the event another player at the opposite side of the field should block the other beam, the overhead segment 82, 82*a*** would not be affected and could be utilized as a reference.

A scrimmage line marker assembly (FIGS. 1 and 11–14) is mounted on trackway 14A and is adapted to direct a laser light beam segment 84 across the field 10 to the opposite sideline 11 at points corresponding to the position of the football at the end of each play by the offensive team. Marker 60 includes: a support pole 61 having its lower end pointed as at 62 to facilitate ground penetration; an L-shaped guide 63 carried by the pole and composed of a laterally extending bar 64 and a pair of spaced plates 65 adapted to straddle one of the rails 15 of the trackway; a step plate 66 extending laterally from the pole; a handle 67; standard equipment 68 at the top of the pole for indicating the number of the down; and a laser beam directing assembly 69.

The marker 60 is provided with a laser 70 having a handle 71, a guide or pipe 72 extending vertically upwardly from the laser and a vertically alined tunnel 73 extending downwardly from the latter, said pipe and tunnel being mounted for vertical movement in brackets 74 and 75 integral with pole 61. A set screw 76 is utilized to adjust the assembly 69 and its components 71–73 to select positions. The lower end of the tunnel 73 is provided with a 90° corner mirror thereon.

The laser 70 projects a segment of a light beam downwardly through tunnel 73 to the mirror **80*g* which reflects another segment 84 thereof horizontally across the field at right angles to the sidelines 11** at a level adjacent and parallel to the field surface.

In the position shown in FIG. 1, the ball 30 is located on the zero line or at the start of the first of four successive plays allowed the offensive team to advance 10 yards to the first down line 83, 83*a*. At the end of each of the four plays the marker 60 is moved longitudinally of trackway 14A to a position corresponding to the location of the ball.

I claim:

1. Apparatus for providing luminous first down lines of demarcation transversely of a rectangular football field, comprising:

a support (18) movable longitudinally adjacent one of the field sidelines (11, 11);

means (20) for releasably anchoring said support in selected positions along said sideline;

means (19, 80) carried by the support for directing a luminous segment (82) of a laser beam (26) across the field and in a vertical plane perpendicular to said sideline, and means (80*d'*, 80*e'*) disposed adjacent the opposite sideline of the field and movable longitudinally adjacent thereof for reflecting a second luminous segment (83) of said beam (26) reversely across said field and in said plane, one of said segments (82, 83) extending horizontally and adjacently above the field surface to provide a ground line of demarcation, and the other of said segments being disposed horizontally thereabove to provide an overhead line of demarcation.

2. The apparatus defined in claim 1 and further comprising: a pair of parallel trackways (14, 14) respectively disposed adjacent said opposite field sidelines (11, 11), and means for mounting said directing and reflecting means for movement longitudinally on said trackways, respectively.

3. The apparatus defined in claim 2 and further comprising: means for supporting each of said trackways substantially flush-top with the surface of the field.

4. The apparatus defined in claim 1 and further comprising: means (21, 36) for vertically adjusting the elevation of said horizontally directed and reflected segments (82, 83) in said plane and relative to the field surface.

5. The apparatus defined in claim 1 and further comprising:

means (19, 80*a'*) on the opposite side of the field from said support (18) for directing a luminous segment (82*a*) of a second laser beam (26*a*) across the field, substantially in said plane, and alongside said first luminous segment (82), and means (80*d*, 80*e*) on the first-named side of the field for reflecting a luminous segment (83*a*) of said second beam (26*a*) reversely across the field, substantially in said plane and alongside said reflected segment (83) of the first beam (26), whereby a visible beam continuity will be maintained across the field when either of said lines of demarcation is blocked intermediate said field sidelines.

6. The apparatus defined in claim 5 and further comprising: means (21, 36) for vertically adjusting the elevation of said directing means (19, 80), (80*d'*, 80*e'*) to position the reversely directed horizontal segments thereof at selected elevations in said plane and relative to the field surface.

7. Apparatus for providing luminous first down lines of demarcation transversely of a rectangular football field, comprising:

a first laser beam assembly (199 movable longitudinally adjacent one of the opposite sidelines (11, 11) of said field;

a second laser beam assembly (19) movable longitudinally adjacent the other of said sidelines;

means (80*d'*, 80*e'*) carried by said second assembly (19) for directing a luminous horizontal beam segment (83) originating from said first assembly across and adjacently above the surface of the field, said segment lying in a vertical plane perpendicular to said sidelines, and means (80*d*, 80*e*) carried by said first assembly for directing a second luminous horizontal beam segment (83*a*) originating from said first assembly reversely of and alongside said first segment (83), substantially in said plane, and across the field, whereby beam continuity across the field will be maintained when said luminous segments are blocked intermediate their respective directing means.

8. The apparatus defined in claim 7 and further comprising: a pair of parallel trackways (14, 14) respectively disposed adjacent said sidelines (11, 11), and means for mounting said directing means for movement longitudinally on said trackways, respectively.

9. The apparatus defined in claim 8 and further comprising: means for supporting each of said trackways substantially flush-top with the surface of the field.

* * * * *